United States Patent [19]

Jensen

[11] Patent Number: 4,630,993

[45] Date of Patent: Dec. 23, 1986

[54] AXIAL-FLOW FAN

[75] Inventor: Carl E. Jensen, Nae stved, Denmark

[73] Assignee: Nordisk Ventilator Co., Nae stved, Denmark

[21] Appl. No.: 717,265

[22] PCT Filed: Jul. 23, 1984

[86] PCT No.: PCT/DK84/00070

§ 371 Date: Mar. 22, 1985

§ 102(e) Date: Mar. 22, 1985

[87] PCT Pub. No.: WO85/00640

PCT Pub. Date: Feb. 14, 1985

[30] Foreign Application Priority Data

Jul. 28, 1983 [DK] Denmark ..... 3458/83

[51] Int. Cl.[4] ..... F04D 5/00

[52] U.S. Cl. ..... 415/53 R; 415/213 C

[58] Field of Search ..... 415/53 R, 52, 11, DIG. 1, 415/172 A, 212 A, 213 C, 208

[56] References Cited

U.S. PATENT DOCUMENTS

| | | | |
|---|---|---|---|
| 2,327,841 | 8/1943 | Hagen | 415/53 R |
| 2,653,754 | 9/1953 | McDonald | 415/53 R |
| 3,677,660 | 7/1972 | Taniguchi et al. | 415/207 |
| 4,375,937 | 3/1983 | Cooper | 415/53 R |
| 4,511,308 | 4/1985 | Russell et al. | 415/213 C |

FOREIGN PATENT DOCUMENTS

| | | | |
|---|---|---|---|
| 110800 | 7/1982 | Japan | 415/53 R |
| 45457 | 4/1939 | Netherlands | 415/DIG. 1 |
| 82/01919 | 6/1982 | PCT Int'l Appl. . | |

*Primary Examiner*—Carlton R. Croyle
*Assistant Examiner*—Donald E. Stout
*Attorney, Agent, or Firm*—Sughrue, Mion, Zinn, Macpeak & Seas

[57] ABSTRACT

The rotor (1) of the fan is surrounded by a casing (5) having inlet and outlet sections (6, 8) interconnected by an enlarged intermediate section (7) defined between and end wall (10) located upstream of the rotor and an end wall (11) axially disposed between the leading and trailing blade edges (12, 13). The annular chamber (9) defined within the intermediate section (7) is subdivided into a plurality of compartments (25) by means of guide vanes (14), the innermost edge zones of which are inclined towards the direction of rotation of the rotor and include an angle of 40° to 65° with a radius to the rotor axis (3). The guide vanes (14) are preferably curved such that they meet the peripheral wall (15) of the annular chamber (9) at right angles. Preferably the inner edges of the guide vanes (14) are interconnected by a ring (22) located midway between the upstream and downstream end walls (10, 11) of the annular chamber (9), and the end portions (19) of the innermost vane edges located between the upstream end wall (10) and the ring (22) are preferably outwardly retracted relative to the remainder (18) of each edge.

9 Claims, 5 Drawing Figures

AXIAL-FLOW FAN

Figure 1:
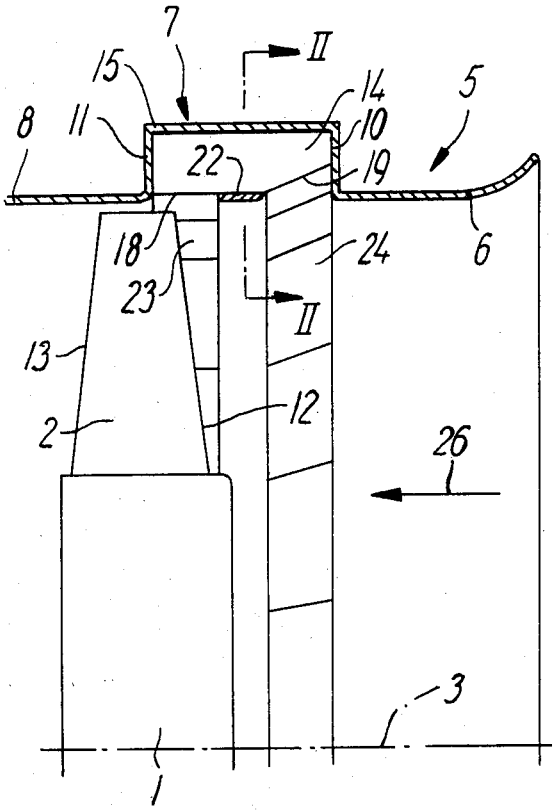

This invention relates to an axial-flow fan comprising a rotor and a surrounding casing. The rotor includes a hub and a plurality of rotor blades extending radially outwards from the hub, and the casing comprises an inlet section located in its entirety upstream of the rotor blades, an outlet section of substantially the same diameter as the inlet section and arranged with its upstream end located in a plane intermediate the leading and trailing edges of the rotor blades, and an intermediate section of larger diameter than the inlet and outlet sections to which it is connected airtight at the downstream and upstream ends, respectively, of those sections whereby the intermediate section defines an annular chamber partly overlapping the tips of the rotor blades. A plurality of stationary guide vanes are secured to the walls of the annular chamber and extend from the upstream to the downstream end thereof, whereby they divide the chamber into a plurality of compartments distributed along its circumference.

In an axial-flow fan of this type, which is known from the published specification of International Application No. PCT/AU81/00181 (WO82/01919), the annular chamber, which partly overlaps the rotor blade tips, is provided for obviating or at least mitigating some undesirable phenomena occurring when the rotor operates in the so-called stalling region or regime, i.e. at a low delivery rate and corresponding high angles of attack at the leading edges of the rotor blades. When stalling occurs at a rotor blade the air flow becomes separated or detached from the convex side of the blade profile, and the resulting stall vortices will move outwardly, due to centrifugal forces, into the annular chamber and be directed back therefrom into the flow upstream of the rotor and mixed therewith. As a consequence of this recycling or backflow the axial inflow velocity at the leading blade edge increases and the angle of attack decreases correspondingly. The quoted specification discloses a plurality of fixed guide vanes disposed within the annular chamber and oriented radially relative to the rotor axis with their radial dimension decreasing to zero at the downstream end wall of the annular chamber. It has been explained in the specification that at low delivery rates there will be obtained a somewhat higher delivery pressure with the stationary guide vanes than without them.

According to the present invention an axialflow fan of the type defined in the opening paragraph above is characterized in that the radially innermost edge zone of each stationary guide vane is oriented towards the direction of rotation of the rotor and includes an angle of between 65° to 40° with a radius from the rotor axis to the inner edge of the vane.

It has been found that by inclining the innermost edge zone of each vane, as provided by the invention, it is possible, inter alia, to eliminate the pressure drop which according to the above discussed prior specification occurs at very low delivery rates, even with guide vanes in the annular chamber. The pressure-versus-volume curves of the fan then exhibit a pressure maximum at or adjacent zero delivery, similar to the characteristics of a centrifugal fan. If the operational conditions of the fan include a risk of substantial overload due to temporarily increased flow resistance, the fan may then still operate at a correspondingly reduced delivery rate without stalling and at a reasonable efficiency.

The advantages obtained by inclining the inner edge zones of the guide vanes are believed to be due to the fact that as soon as an outwardly traveling stall vortex loses contact with the tip of a rotor blade, the mass of air within the vortex is so to speak intercepted by an edge zone of a guide vane and guided, by the vane, into one of the compartments, into which the annular chamber is subdivided by the vanes. At the blade tip each stall vortex has, in addition to its proper swirl, a tangential and a radial velocity component. The tangential velocity component can be regarded as constant at a constant rate of revolution of the rotor, while the radial velocity component resulting from the centrifugal force increases with decreasing radius from the rotor axis to the point of the blade surface where flow separation starts. It has however been found that the angle included between the composite velocity vector and the radius from the blade tip varies relatively little with varying radius to the point of separation. When the inclination of the inlet zone of each vane is chosen within the defined range, it is possible to ensure that with reasonable approximation the direction of said inlet zone coincides with the velocity vector of the stall vortex, irrespective of the delivery rate of the fan.

Excellent results have been obtained with guide vanes in which the angle included between said inner edge zone and the associated radius was 55°±5°.

The cross-sectional profile of the guide vane, i.e. a section therethrough perpendicular to the rotor axis, may be curvilinear with its concavity facing the direction of rotation of the rotor, with the guide vane meeting the outer of peripheral wall of the annular chamber at an angle of 90°±10°. In that embodiment the flow reversal of the stall vortex at the bottom of the annular chamber takes place with minimal losses, possibly because secondary vortices, which would be created with a flat vane meeting the chamber bottom wall at an acute angle, are avoided.

According to a feature of the invention the upstream end portion of the radially inner edge of each guide vane may be radially retracted relative to the downstream end portion of that edge. The retracted end portion may expediently include from 25% to 35% of the total axial length of the vane edge.

In a preferred embodiment of the invention, the inner edges of the guide vanes are interconnected by a ring having an inner diameter substantially equal to the diameters of the outlet and inlet sections of the casing and located axially between those sections so as to define inlet and outlet passages, respectively, to and from the annular chamber; the axial dimensions of said inlet and outlet passages are substantially equal and each of them is between 25% and 35% of the axial length of the annular chamber; and the retracted upstream end portions of the inner guide vane edges extend outwardly from the upsteam end face of the interconnecting ring.

It has been found that this embodiment combines a substantial reduction of the disturbing influence, which the annular chamber unavoidably exerts on the normal operation of the fan, with practically unchanged favourable influence on the operation of the fan within the stalling regime, including improved stability and less vibrations and noise. While the interconnecting ring, which has been previously proposed in combination with guide vanes located in the outlet passage only of the annular chamber, i.e. the upstream part of the chamber, but not in the inlet passage, improves the efficiency during normal operation (no reverse flow through the annular chamber) by reducing the flow resistance due to the presence of that chamber, the retracted or cut-off edges of the guide vanes defining the outlet passages from the individual compartments have been found to result in an unexpected further improvement of the optimum efficiency obtainable with a given fan.

Preferably the retracted end portions of the vane edges follow straight lines or concave curves.

The upstream end point of each retracted edge portion may be radially offset relative to the downstream end point thereof by an amount equal to between 20% and 100% of the radial depth of the annular chamber.

Figure 2:
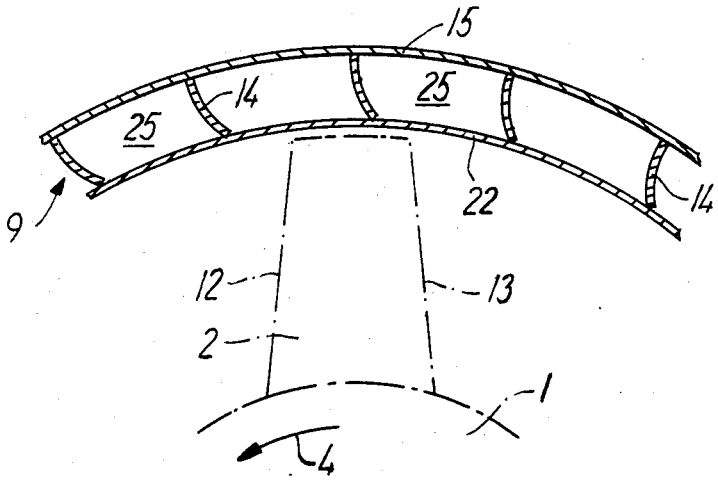
Figure 3:
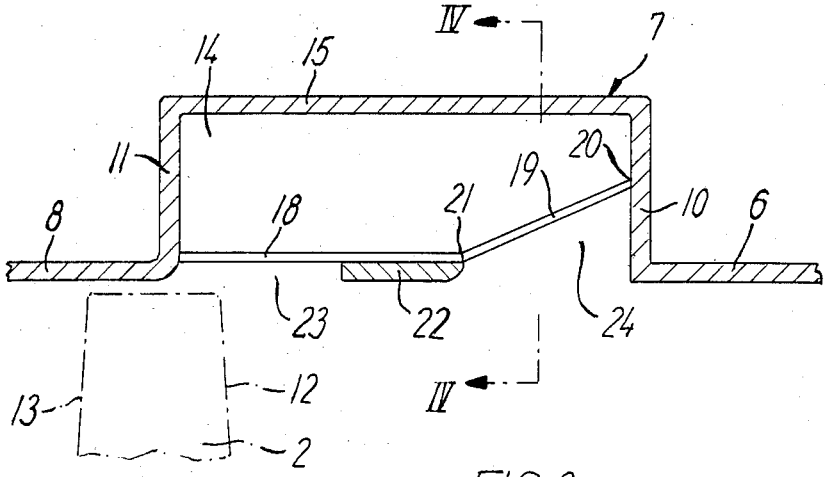
Figure 4:
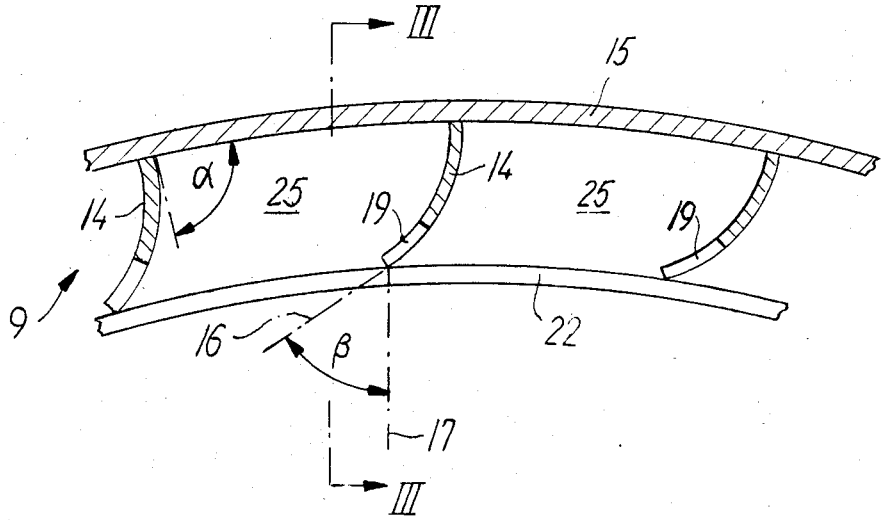
Figure 5:
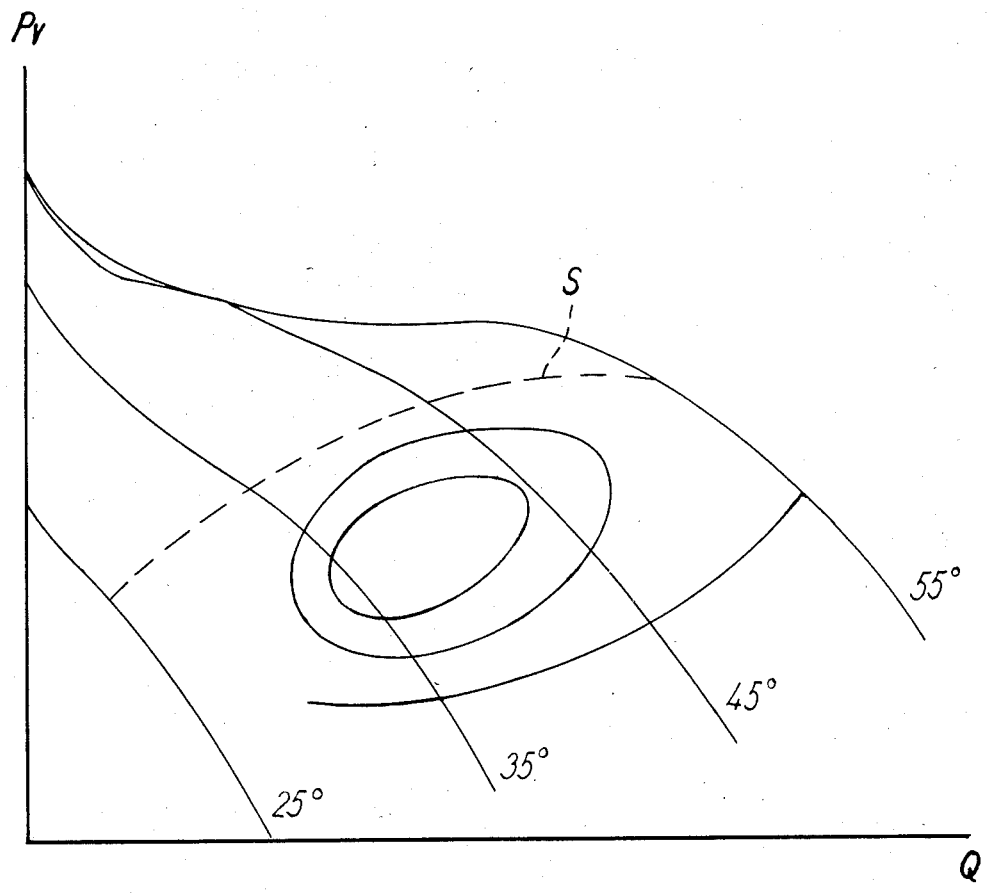

The invention will be explained in more detail below with reference to the accompanying schematical drawings in which:

FIG. 1 is an axial section through a preferred embodiment of an axial-flow fan embodying the present invention, whereby only one half of the rotor proper and the surrounding part of the fan casing have been shown, FIG. 2 is a fractional view taken along line II—II of FIG. 1, FIG. 3 is a section through the intermediate section of the fan casing only, similar to FIG. 1, but on a larger scale and corresponding to the sectional line III—III in FIG. 4, FIG. 4 is a section along line IV—IV of FIG. 3, and FIG. 5 is a diagram showing the relationship between the delivery rate and the pressure increase in a fan according to the invention and having adjustable blades.

For the sake of clarity, only those component parts of the fan have been shown which are believed to be necessary for the understanding of the invention. Thus, in FIGS. 1 and 2 the fan rotor has been illustrated by way of its hub 1 and a single blade 2 only, but it will be understood that there may be provided any suitable number of rotor blades, fixed or adjustable, and that the rotor hub is secured to a drive shaft (not shown) supported for rotation about an axis 3 in the direction of arrow 4 (FIG. 2). The outer fan casing, generally designated by 5, comprises an inlet section 6, an intermediate section 7, and an outlet section 8. Except for the funnel-shaped mouth of inlet section 6, all three sections are cylindric with circular cross sections, and the inner diameters of sections 6 and 8 are substantially the same while the inner diameter of intermediate section 7 is larger so that an annular chamber generally designated by 9 is defined by the inner surfaces of the peripheral and end walls of section 7. Said end walls 10 and 11 are preferably flat, annular walls, as shown, and preferably the corner, where the downstream end wall 11 meets outlet section 8, is radiused as most clearly seen in FIG. 3.

The upstream end wall 10 of chamber 9 is located upstream of the leading edges 12 of rotor blades 2 while the downstream end wall 11 is disposed axially between the leading edges and the trailing blade edges 13. Consequently there is a certain axial overlap between chamber 9 and the rotor blade tips and the magnitude of that overlap may expediently amount to approximately 30% of the length of the blade tips projected onto a plane through the rotor axis (as in FIG. 1). In a fan with angularly adjustable rotor blades the length referred to will be measured at an adjusted blade angle corresponding to maximum fan efficiency.

Within the annular chamber 9 a plurality of stationary guide vanes 14 have been secured, e.g. by welding, to the peripheral wall 15 of section 7 and to end walls 10 and 11. As shown, each guide vane 14 is formed as part of a cylinder with constant or substantially constant radius of curvature and it is secured to the walls of section 7 in such a way that at the bottom of chamber 9 it adjoins the peripheral wall 15 thereof at an angle $\alpha$ which is approximately a right angle. Each guide vane 14 is arranged with its generatrices extending in parallel to axis 3 and with its concave surface oriented towards the direction of rotation of rotor 1, 2, as illustrated by arrow 4 in FIG. 2. Accordingly, the radially innermost edge zone of each vane 14, more particular the tangent 16 thereto, forms an acute angle $\beta$ with a radius 17 connecting the inner edge of the vane with axis 3 (FIG. 4). According to the invention the value of angle $\beta$ will be between 40° and 65°.

The inner edge of each guide vane is composed of a downstream portion 18 which extends in parallel to axis 3, and an upstream portion 19 which, as illustrated, may be retracted so that it connects to end wall 10 at a point 20 which is offset radially outwards with respect to the point of junction 21 between edge portions 18 and 19.

The downstream edge portions 18 of all vanes 14 are interconnected by means of a ring 22 which, as shown in FIG. 3, extends in the downstream direction from point 21. In addition to providing a mechanical connection between vanes 14, to which it may be welded, ring 22 serves to define, in connection with the end walls 11 and 10, respectively, of chamber 9 an inlet passage 23 to that chamber and an outlet passage 24 therefrom, respectively. Preferably the ring 22 is arranged such that the axial dimensions of passages 23 and 24 are equal or substantial equal and that the axial length of each passage is between 25% and 35% of the length of the chamber between walls 10 and 11. Preferably the inner diameter of ring 22 is the same as the inner diameter of sections 6 and 8 of casing 5, and shown in FIG. 3 its upstream end, at point 21, should be radiused, like the edge where wall 11 joins outlet section 8.

If stalling occurs at one or more of the rotor blades 2 due to flow separation on the convex blade surface, there will be formed one or more swirling vortices which, due to the centrifugal force acting on the mass of air therein, travel outwardly along the blade surface until they enter the annular chamber 9 through the inlet passage 23 thereto. As mentioned above the swirling vortices also rotate about axis 3, although with a tangential or angular velocity lower than the tangential or angular velocity of rotor 1, 2. The last mentioned rotation of each vortex is decelerated when the vortex flows into one of the compartments or cells 25 which are defined within chamber 9 between successive guide vanes 14. From the bottom of each compartment 25 the vortex is deflected radially inwards so as to leave the compartment 25 through outlet passage 24.

The recycled air flowing out of a compartment 25 through passage 24 to get mixed with the incoming air flowing in the direction of arrow 26 (FIG. 1) through inlet section 6, will have a certain component of rotation counter to the direction in which rotor 1, 2 rotates, This counterrotation, which is due to the particular shape and orientation of guide vanes 14, will to some extent be reduced by the outward inclination of vane edges 19, and the reduction will be larger, the larger the outward offset of end point 20 is. This offset may go up to 100% in which case point 20 would coincide with the intersection of chamber walls 10 and 15, and preferably it should be at least 20% of the radial depth of chamber 9, as measured between wall 15 and ring 22. Preferably the latter dimension of chamber 9 is approximately 40% of the inner distance between end walls 10 and 11.

It will be seen from the diagram of FIG. 5, which shows the interrelation between the delivery rate Q and the fan pressure $P_v$ at different blade angles ranging from 25° to 55°, that throughout that range the pressure increases continually with decreasing delivery rate, and further that the fan may operate without noticeable stalling practically down to zero delivery. A broken line S in FIG. 5 indicates the approximate limit of the stall-free region of a similar fan without the annular chamber and the related features of the invention, as described above. FIG. 5 also includes a few curves representing operational conditions of constant efficiency. Bearing in mind that the fan will normally be designed to operate close to the point of maximum efficiency, it will be understood that the characteristics shown in FIG. 5 leave room for quite substantial temporary overloads.

Finally, it may be mentioned that instead of being mounted in parallel to the rotor axis, the guide vanes within the annular chamber may be oriented at an angle, which may range from 0° to 45°, with that axis. An effect of such skewed mounting of the vanes would be to further reduce the counterrotation, referred to above, of the air leaving chamber 9 through outlet passage 24, and thereby to arrive at discharge pressures at extremely low delivery rates which are somewhat lower than those shown in FIG. 5.

I claim:

1. An axial flow fan comprising; a rotor adapted to rotate in a predetermined direction about an axis and having a hub and a plurality of rotor blades each of which extends radially outwards from the hub and terminates in a blade tip, each rotor blade having a leading and a trailing edge;

a casing coaxially surrounding the rotor and including an inlet section having a downstream end located upstream of the rotor blades, an outlet section of substantially the same diameter as the inlet section and having an upstream end located in a plane extending normally to the rotor axis intermediate the leading and trailing edges of the rotor blades, and an intermediate section connecting the inlet and outlet sections and having a larger diameter than those sections, said intermediate section being defined by a peripheral wall and two end walls and being attached to the downstream end of the inlet section and the upstream end of the outlet section, respectively, whereby said peripheral and end walls define an annular chamber partly overlapping the blade tips of the rotor;

a plurality of guide vanes angularly spaced within said annular chamber, thereby dividing the chamber into a plurality of compartments distributed along the circumference thereof, each guide vane being secured to the walls of the annular chamber and extending from one end wall to the opposite end wall thereof and having a radially innermost edge zone which is oriented into the predetermined direction of rotation of the rotor and includes an angle of between 65° and 40° with an associate radius connecting the inner edge of the vane with the rotor axis.

2. A fan as claimed in claim 1, wherein the angle included between said edge zone of each guide vane and the associated radius is 55°±5°.

3. A fan as claimed in claim 1, wherein each guide vane has a curvilinear cross-sectional profile with a concavity facing the direction of rotation of the rotor, and the guide vane meets the peripheral wall of the annular chamber at an angle of 90°±10°.

4. A fan as claimed in claim 1, wherein the inner edge of each guide vane comprises an upstream portion and a downstream portion, and the upstream portion of each edge is located further from the rotor axis than the downstream portion of the edge.

5. A fan as claimed in claim 4, wherein said upstream portion of each vane edge includes from 25% to 35% of the total axial length of the edge.

6. A fan as claimed in claim 4, further comprising a connecting ring secured to the inner edge of each guide vane, said ring having an inner diameter substantially equal to the outlet and inlet sections of the fan casing and located axially between those sections so as to define axially spaced inlet and outlet passages, respectively, to and from the annular chamber;

said inlet and outlet passages having substantially equal axial dimensions amounting to between 25% and 35% of the axial distance between the end walls of the annular chamber;

and wherein said upstream portion of each inner guide vane edge extends between the upstream end of the connecting ring and the upstream end wall of the annular chamber.

7. A fan as claimed in claim 6, wherein said upstream portion of each vane edge extends along a substantially straight line between its end portions.

8. A fan as claimed in claim 15, wherein the upstream end portion of each said upstream edge portion is offset relative to the downstream end point thereof by an amount equal to between 20% and 100% of the radial depth of the annular chamber.

9. A fan as claimed in claim 10, wherein the radial depth of the annular chamber is approximately 40% of its axial length.

* * * * *